US005363580A

United States Patent [19]

Nishigawa

[11] Patent Number: 5,363,580

[45] Date of Patent: Nov. 15, 1994

[54] SWITCHING MECHANISM OF AN EJECTOR IN GUN

[75] Inventor: Tadahiro Nishigawa, Kohchi, Japan

[73] Assignee: Kabushiki Kaisha Miroku Seisakusho, Kohchi, Japan

[21] Appl. No.: 82,871

[22] Filed: Jun. 29, 1993

[30] Foreign Application Priority Data

Sep. 4, 1992 [JP] Japan ..... 4-237173

[51] Int. Cl.[5] ..... F41A 15/06

[52] U.S. Cl. ..... 42/48

[58] Field of Search ..... 42/47, 48

[56] References Cited

U.S. PATENT DOCUMENTS 1,692,995 11/1928 Murphy ..... 42/48
3,323,245 6/1967 Fukami ..... 42/48
3,882,626 5/1975 Vervier ..... 42/47

FOREIGN PATENT DOCUMENTS 938479 12/1973 Canada ..... 42/47
52-5883 1/1977 Japan .

*Primary Examiner*—Stephen M. Johnson
*Attorney, Agent, or Firm*—Lowe, Price, LeBlanc & Becker

[57] ABSTRACT

An object of the present invention is to provide a switching mechanism of an ejector which is simple to operate and in which projecting portions on a gun are minimized. A hammer is pivoted to return to the original position when a breech is opened after a gun is fired, whereby a projection of the hammer abuts against a head of a trip rod. Thus, the trip rod is shifted longitudinally and the ejector mechanism is operated. A spiral guide which is engaged with the trip rod is formed on a selector button adjacent to the trip rod, and a groove for rotation is formed on an end surface of the selector button. When the selector button is rotated, the trip rod is shifted in the direction which intersects with its longitudinal direction, thereby switching between a state in which the projection abuts against the head and another state in which they are not abutted against each other.

6 Claims, 7 Drawing Sheets

SWITCHING MECHANISM OF AN EJECTOR IN GUN

BACKGROUND OF THE INVENTION

1. Field of the Invention

The present invention relates to an ejector mechanism in a gun, and more particularly, to a mechanism for suspending when necessary an operation of an ejector mechanism so that an empty cartridge case will not pop out, and that the cartridge case can be easily recovered.

2. Description of the Related Art

Conventionally, a cartridge case of a breech-type gun is adapted to automatically pop out from a chamber when the breech is opened to load another bullet after the gun is fired. However, when reused, it is sometimes difficult to recover the cartridge case popped out. Also, the cartridge case may get dirty and deformed when it pops out and then drops. Also, pollution will be caused if the empty cartridge case is left somewhere after use. Thus, there has developed a demand that the cartridge case remain in a chamber and be recovered without operating the ejector mechanism when necessary.

In view of the foregoing problems, the applicant has proposed a switching mechanism of an ejector in Japanese Patent No. 525883 (U.S. Pat. No. 3,323,245), which is constructed as shown in FIGS. 6 and 7.

First, an ejector mechanism will be described with reference to FIG. 6. When a breech is opened to load a ammunition in a chamber, a hammer 1 is pivoted clockwise so as to allow a projection 1*a* projecting from the hammer 1 to shift along a slope 2*b* of a head 2*a* of a trip rod 2 which is formed of an elongated round bar and to allow the trip rod 2 to shift to the left side of the drawing. In accordance with this shift to the left side, the trip rod 2 is pivoted clockwise together with a receiver as the breech is opened so that the left end of the trip rod 2 abuts against a recess on the right side of the ejector sear 3, thereby rotating the ejector sear 3 counterclockwise. The left end surface of the ejector sear 5 abuts against the right end surface of an ejector hammer 4, thus preventing the ejector hammer 4 from being pivoted clockwise. However, the ejector sear 3 is disengaged from the ejector hammer 4 when the ejector sear 3 is, as mentioned above, pivoted counterclockwise so that the ejector hammer 4 is pivoted clockwise by a spring. When the ejector hammer 4 is pivoted, the ejector 5 is shifted diagonally to the upper right, thus popping out the cartridge case 6 from the chamber.

A description of a switching mechanism will be given now. A taper pin 7 is embedded in the vicinity of the right end of the trip rod 2 such that it intersects with the trip rod 2. The taper pin 7 is slidable longitudinally (the vertical direction in the drawing), and as shown in FIG. 7, it is integrally coupled with a handle 8 projecting from the side of the gun, thereby allowing the taper pin 7 to be slid from the outside of the gun. As illustrated in FIG. 7, the taper pin 7 slides perpendicular to the plane of the drawing and the head 2*a* of the trip rod 2 shifts upwards and downwards as indicated by the arrow in FIG. 7. In FIG. 7, the head 2*a* is shifted upwards in the drawing to be positioned above the projection 1*a* by operating the handle 8, so that when the breech is opened, the trip rod 2, being not in contact with the projection 1*a*, does not move longitudinally. Therefore, the ejector mechanism is not operated and the cartridge case remains in the chamber. When the handle 8 is operated to slide the taper pin 7 and to move the head 2*a* downwards in FIG. 7 into contact with the projection 1*a*, the ejector mechanism is operated as stated above, and the cartridge case pops out from the chamber.

However, in the foregoing switching mechanism, the handle 8 protrudes considerably from the side of the gun, and thus it becomes an obstacle during operation of the gun.

Also, if the taper pin 7 is made easily slidable, in may be easily shifted due to a shock of firing or the like, so that it has to be set firm to some degree. Nevertheless, this makes sliding of the taper pin 7 by the handle 8 difficult, in particular, when the handle becomes slippery due to perspiration from fingers, rain, and the like during a shooting game, etc. In order to solve this problem, as illustrated in the drawing, an engaging device 9 which is urged by a spring is provided orthogonal to the taper pin 7 so that the engaging device is inserted into a recess formed on the taper pin 7 to hold the taper pin in position. However, such a structure is not always satisfactory. Furthermore, machining of the taper pin 7 and the engaging device 9 as well as machining for their installation in the receiver portion of a gun are complicated, which inevitably makes the assembling work difficult.

SUMMARY OF THE INVENTION

In view of the foregoing problems, an object of the present invention is to provide a switching mechanism of an ejector in which the shape and construction of its members are simplified, machining and assembling operations are simple, and performance thereof is prevented from being reduced due to a shock, and in which protruding portions on the surface of a receiver are minimized, thus providing a good operational performance.

To achieve the above object, there is provided a switching mechanism of an ejector mechanism in a gun, the ejector mechanism including a hammer with a projection adapted to pivot to return to an original position thereof when a breech of the gun is opened after firing, and a trip rod engaged by the projection as the hammer returns to the original position and moves longitudinally to drive an ejector, the switching mechanism comprising: a selector button disposed adjacent the trip rod, rotatable around an axis which intersects with an axis of the trip rod, one end of the selector button exposed to an outside of the gun; a spiral guide provided on an outer periphery of the selector button for engagement with the trip rod; and a groove formed on a surface of the exposed end of the selector button for rotating operation of the selector button; wherein on rotation of the selector button, the trip rod is moved in a direction which intersects with the axis of the trip rod so that the trip rod is brought into and out of engagement with the projection of the hammer.

When a selector button is rotated by turning a screwdriver or the like inserted into a groove for rotation, a trim rod being engaged with a spiral guide is moved in a direction which intersects with the longitudinal direction of the trip rod, thereby switching between a state in which the trip rod and a projection of a hammer are engaged with each other and another state in which they are released from each other. When the trip rod and the hammer are engaged with each other, the ejector mechanism is operated and the cartridge case pops out, and when not, the ejector mechanism is not operated and the cartridge case remains in the chamber and can be recovered easily.

DESCRIPTION OF THE PREFERRED EMBODIMENTS

Figure 1:
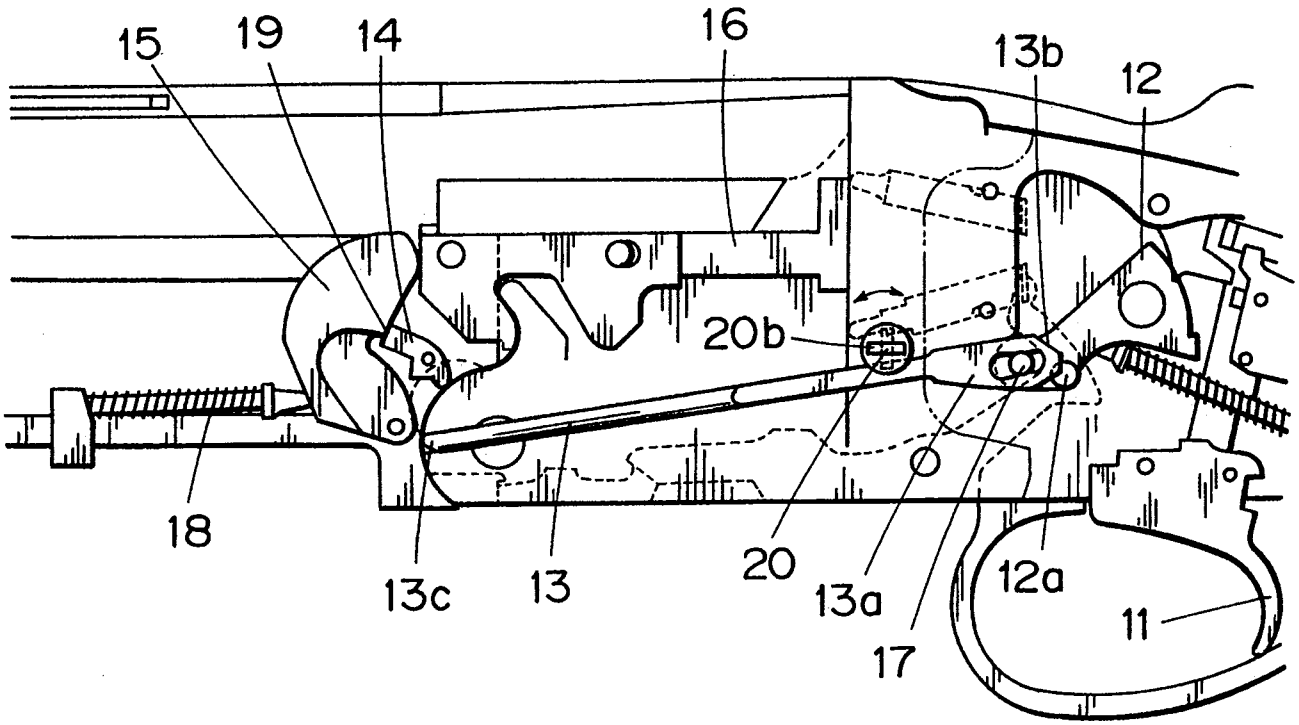
FIG. 1 is a side view showing an ejector mechanism including a switching mechanism according to this invention, in a ready for firing state.
Figure 2:
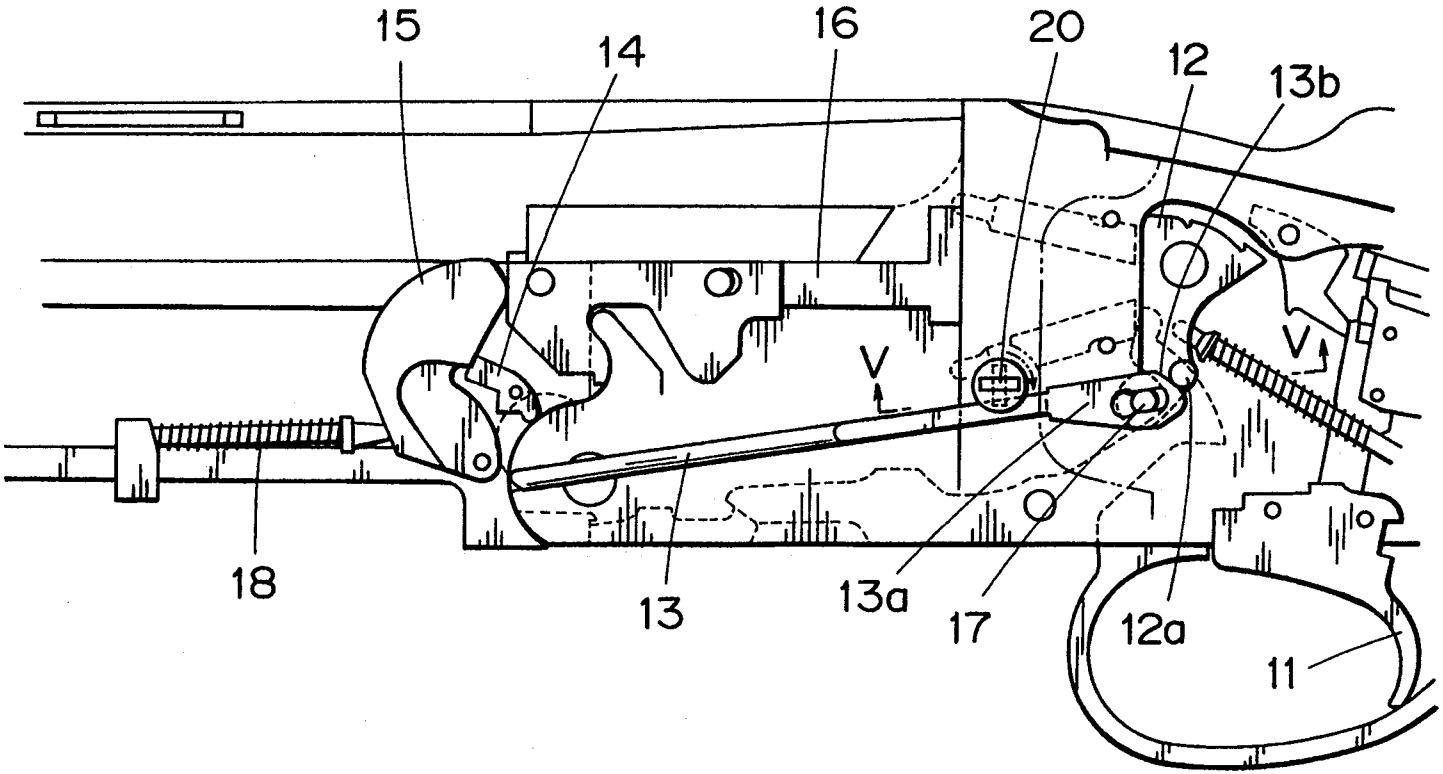
FIG. 2 is a side view showing the ejector mechanism in an after firing state.
Figure 3:
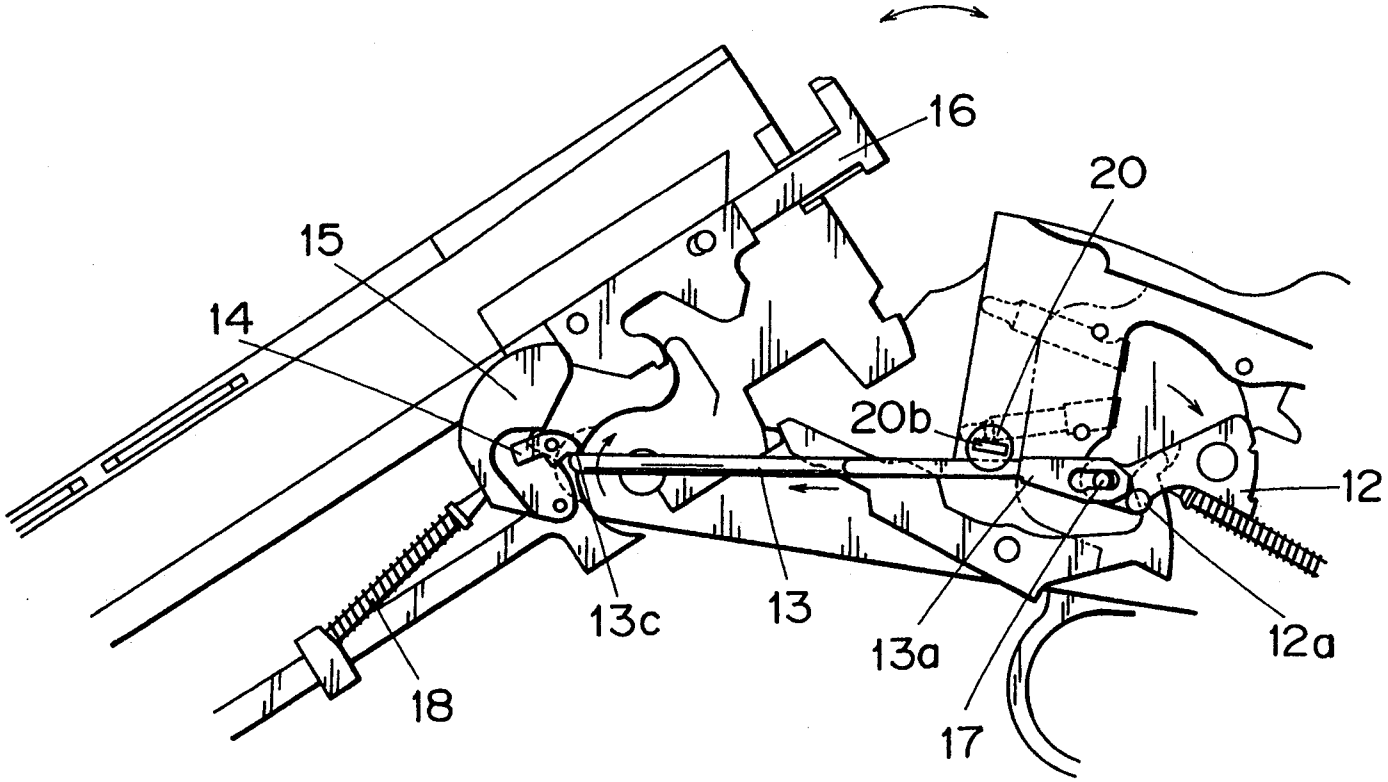
FIG. 3 is a side view showing the ejector mechanism in an operating state.

FIGS. 1–3 show a construction of an ejector mechanism including a switching mechanism according to the present invention. FIG. 1 shows the ejector mechanism in a ready for firing state; FIG. 2 indicates the ejector mechanism in an after firing state; and FIG. 3 shows the ejector mechanism in an operating state.

Figure 6:
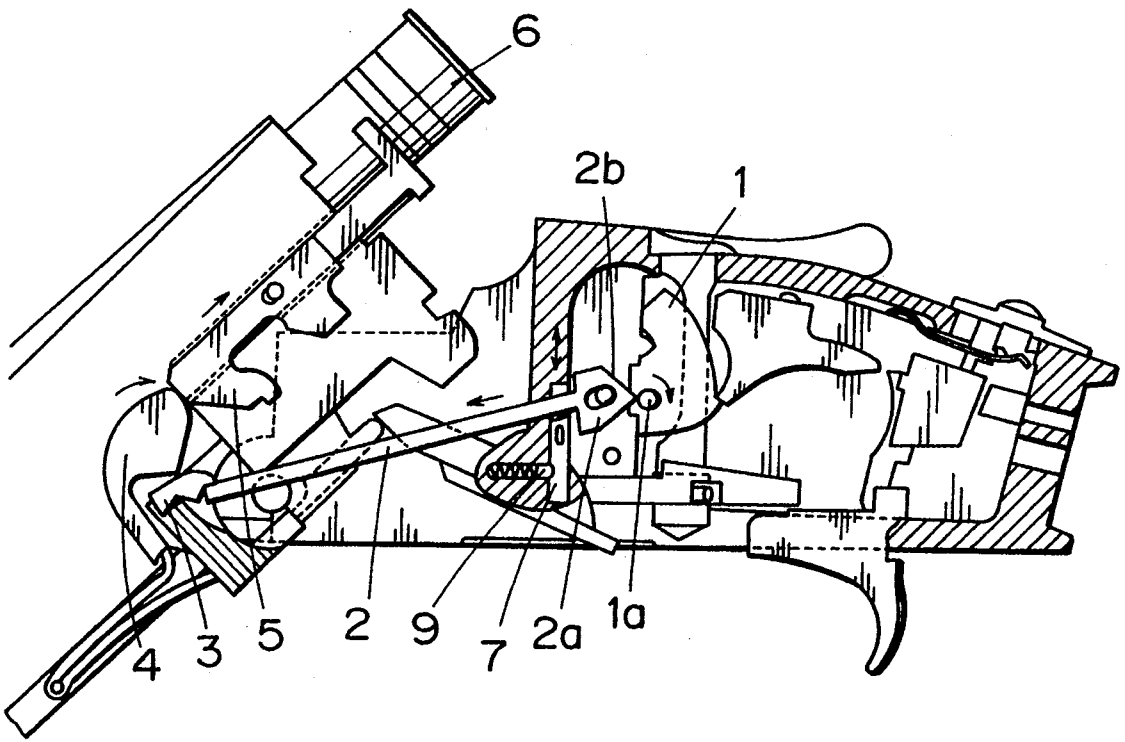
FIG. 6 PRIOR ART
FIG. 6 is a front view showing an ejector mechanism including a conventional switching mechanism.
Figure 7:
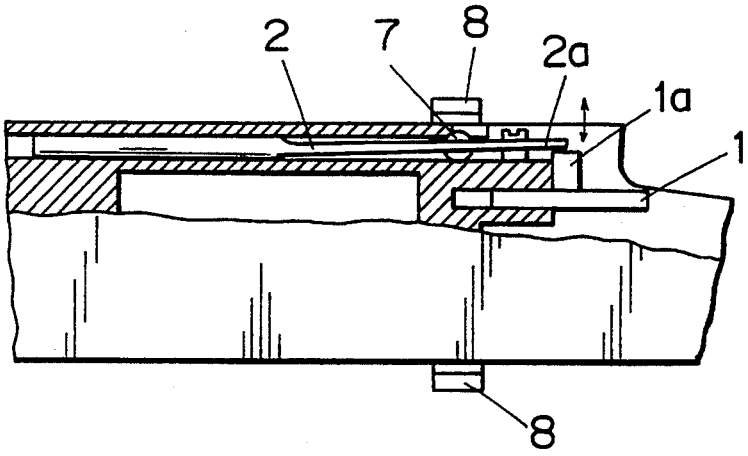
FIG. 7 PRIOR ART
FIG. 7 is a sectional view showing an essential portion of the conventional switching mechanism.

An ejector mechanism of the present invention includes a trigger 11, a hammer 12, a projection 12*a* projecting from the hammer, a trip rod 13, a head 13*a* of the trip rod 13, an ejector sear 14, an ejector hammer 15, and an ejector 16. These components are substantially the same as those of the conventional example described in FIGS. 6 and 7. The ejector mechanism also includes a pin 17 and a spring 18. The pin 17 passes through an elongated hole formed longitudinally on the trip rod 13 to position the head 13*a* of the trip rod 13 and also pivot the hammer 12. The spring 18 urges the ejector hammer 15 to pivot clockwise. The ejector hammer 15 abuts against the ejector sear 14 at an engaging portion 19, thereby preventing the ejector hammer from pivoting clockwise.

In FIG. 1, the projection 12*a* is positioned below the head 13*a* of the trip rod 13, so that when a breech is opened, the projection 12*a* is not able to shift the trip rod 13, and thus the ejector mechanism cannot be operated.

After the gun is fired, the hammer 12 pivots counterclockwise to be positioned as viewed in FIG. 2, so that the projection 12*a* passes along the bottom surface of the head 13*a* to abut against an upper slope 13*b*. As illustrated in FIG. 3, when the breech is opened, the hammer 12 returns to its original position so as to pivot around the pin 17. Accordingly, the projection 12*a* presses the upper slope 13*b* so as to allow the trip rod 13 to be thrust out to the left side in FIG. 3 and the end 13*c* of the trip rod 13 to protrude. Since the trip rod 13 is also pivoted clockwise together with a receiver as the breech is opened, the end 13*c* is engaged with a recess on the right side of the ejector sear 14 to pivot the ejector sear 14 counterclockwise. Thus, the engaging portion 19 is disengaged, and the ejector hammer 15 is pivoted clockwise by the spring 18, and further the ejector 16 is pushed up to the upper right, thereby popping out a cartridge case.

A description of a switching mechanism of the ejector will now be given. In FIG. 1, a selector button 20 is attached in the vicinity of the head 13*a* of the trip rod 13 by forming a hole in a receiver portion.

Figure 4A:
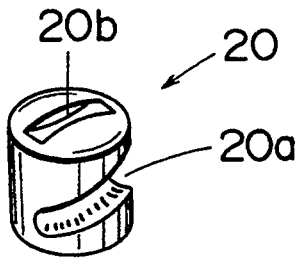
FIG. 4A is a perspective view of a selector button according to this invention.

As shown in FIG. 4A, the selector button 20 is substantially cylindrical and is attached such that a central axis thereof intersects with the trip rod 13. A grooved spiral guide 20*a* is formed on the periphery of the selector button 20 and a groove for rotation 20*b* is provided on top of the selector button 20. It will be apparent that the spiral guide is not limited to a groove shape but may instead have other shapes such as a spiral rib or the like.

Figure 4B:
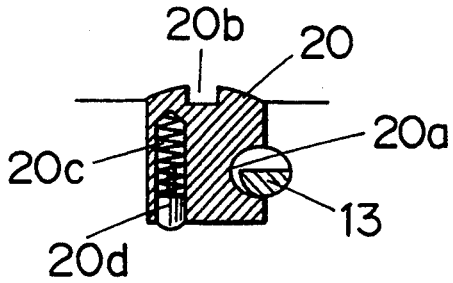
FIG. 4B is a longitudinal sectional view of the selector button.
Figure 4C:
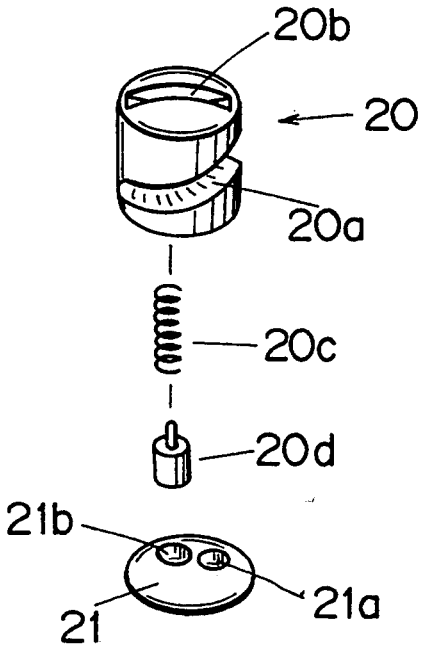
FIG. 4C is an exploded perspective view of the selector button.

FIG. 4B shows a sectional view of the selector button 20. As shown in the drawing, the trip rod 13 is engaged with the spiral guide 20*a*, and a hole is provided parallel to the central axis in the selector button, into which hole a spring 20*c* and a plunger 20*d* having a semi-spherical shaped top are fitted. As illustrated in FIG. 4C, a bottom surface 21 of the hole formed in the receiver portion has two semi-spherical recesses 21*a* and 21*b* into which the end of the plunger 20*d* can be inserted.

FIG. 5 is a sectional view taken on line V—V of FIG. 2. As shown in these drawings, the selector button 20 is rotatably fitted into the hole of the receiver portion, and the trip rod 13 is engaged with the spiral guide 20*a*. It should be noted that the selector button 20 need not protrude to the outside of the gun, insofar as a screwdriver can be inserted into the groove for rotation 20*b* from the outside. Therefore, the selector button 20 does not become an obstacle. Also, the torque required for rotation can be adjusted flexibly because the selector button can be rotated easily even if it is fixed firmly to such a degree that it does not move accidentally due to a shock of firing or the like.

Figure 5A:
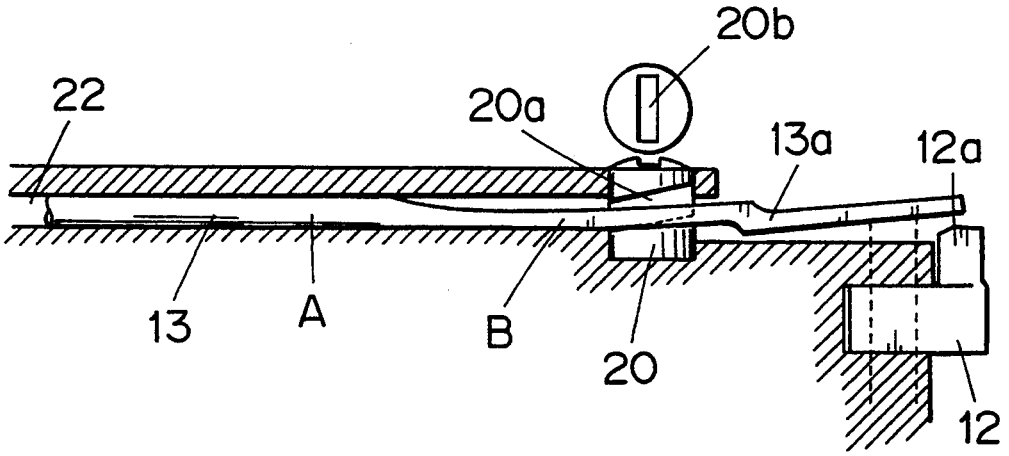
FIG. 5A is a sectional view taken on line V—V of FIG. 2 showing an essential portion of the switching mechanism in a non-operating state.

As illustrated in FIG. 5A, the selector button 20 is rotated to a position where the groove for rotation 20*b* is vertical so as to allow the plunger 20*d* to be inserted into either of the recesses 21*a* or 21*b* and be positioned therein. The portion A of the trip rod 13 has a circular section and is accommodated in an elongated hole 22 which is provided in the receiver portion. On the other hand, the portion B is chipped into substantially a semi-circular shape and has an enlarged head 13*a* by flattening. As stated above, the portion B has a semi-circular section, thereby producing a spring stress which further normally urges the selector button 20 downwards as viewed in FIG. 5 (*a*). The portion B of the trip rod 13 is movable upwards and downwards in the hole 22. It is guided by the spiral guide 20*a* to be lifted upwards in the drawing when the selector button 20 is rotated as described above, thus preventing the projection 12*a* from abutting against the head 13*a* even when the hammer 12 is pivoted. In such position, when the breech is opened after firing, the projection 12*a* does not move the trip rod 13, and thus the ejector mechanism is not operated. As a result, a cartridge case remains in a chamber and can be recovered easily.

Figure 5B:
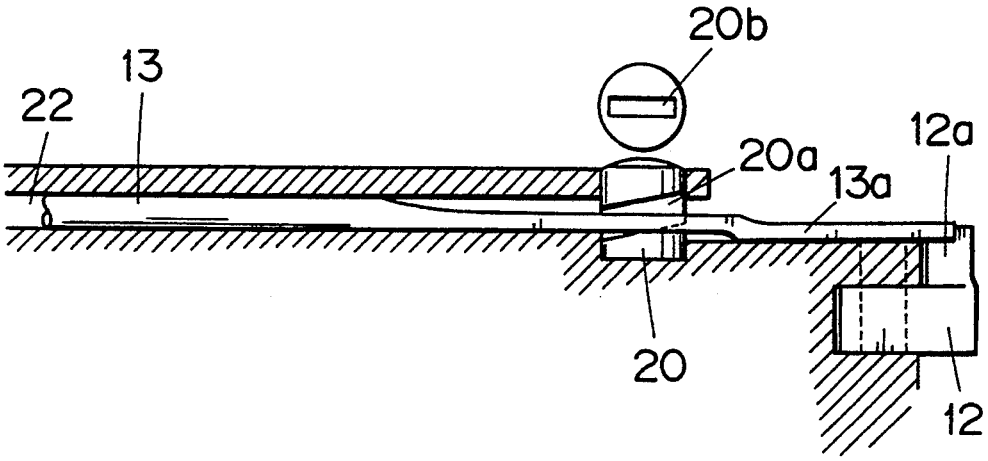
FIG. 5B is a view similar to the above showing the ejector mechanism in an operating state.

As illustrated in FIG. 5B, the groove for rotation 20*b* is rotated by a screwdriver or the like, so as to be horizontal, and thus the plunger 20*d* is inserted into the remaining recess 21*a* or 21*b* and positioned therein. The trip rod 13 is guided by the spiral guide 20*a* to be lowered so that the projection 12*a* abuts against the head 13*a* to shift the trip rod 13 longitudinally when the hammer 12 is pivoted. Thus, as stated above, the ejector mechanism is operated so that the cartridge case pops out.

It is convenient if the groove for rotation **20*b*** is formed to be rotatable not only by a screwdriver but also by a coin or the like.

Consequently, the present invention offers the following advantages.

Since the selector button for switching an ejector according to this invention is of a rotation type, the selector button can be kept from protruding outside a gun. Also, with easy rotatability, the selector button can be set firmly, thereby excluding its accidental movement and providing easy handling. Furthermore, machining and assembling are extremely simplified since a single hole for the selector button is formed in the receiver portion.

What is claimed is:

1. A switching mechanism of an ejector mechanism in a gun, said ejector mechanism including a hammer with a projection adapted to pivot to return to an original position thereof when a breech of the gun is opened after firing, and a trip rod engaged by said projection as said hammer returns to the original position and moves longitudinally to drive an ejector, said switching mechanism comprising:

a selector button disposed adjacent said trip rod, rotatable around an axis parallel to an axis intersecting with an axis of the trip rod, one end of said selector button exposed to an outside of the gun;

a spiral guide provided on an outer periphery of said selector button for engagement with said trip rod; and a groove formed on a surface of said one end of the selector button for rotating operation of the selector button;

wherein on rotation of said selector button, the trip rod is moved laterally so that the trip rod is brought into and out of engagement with said projection of the hammer.

2. A switching mechanism as recited in claim 1, wherein said selector button is cylindrical in shape.

3. A switching mechanism as recited in claim 1, wherein said spiral guide on an outer periphery of the selector button comprises a groove.

4. A switching mechanism as recited in claim 1, further comprising a hole formed in a bottom surface of the selector button in such a manner as to extend parallel to a central axis of the selector button, a spring received in said hole, and a plunger provided at a proximal end of the spring such that it is urged to protrude from the hole.

5. A switching mechanism as recited in claim 4, further comprising a pair of recesses formed on the gun, selectively engaged by said plunger to hold the selector button in a predetermined angular position.

6. A switching mechanism as recited in claim 1, wherein said trip rod is semi-circular at a portion adjacent said selector button such that the trip rod is normally urged in a direction toward engagement with said projection of the hammer.

* * * * *